United States Patent [19]

Meinert

[11] Patent Number: 4,600,911

[45] Date of Patent: Jul. 15, 1986

[54] ELLIPTICALLY SHAPED MAGNETIC CORE

[75] Inventor: Heinz Meinert, Zemst, Belgium

[73] Assignee: Pauwels-Trafo Belgium N.V., Mechlin, Belgium

[21] Appl. No.: 711,817

[22] Filed: Mar. 14, 1985

[30] Foreign Application Priority Data

Mar. 20, 1984 [BE] Belgium ..... 60366

[51] Int. Cl.[4] ..... H01F 27/24

[52] U.S. Cl. ..... 336/212; 336/233; 335/297

[58] Field of Search ..... 335/281, 296, 297; 336/211, 212, 216, 217, 233, 234

[56] References Cited

U.S. PATENT DOCUMENTS 3,464,041 8/1969 Waterman ..... 336/234 X
3,577,109 5/1971 Foster ..... 336/234 X
3,781,740 12/1973 Kirmis et al. ..... 336/233 X

FOREIGN PATENT DOCUMENTS 1493312 7/1967 France ..... 336/212
2002184 10/1969 France ..... 336/216

*Primary Examiner*—George Harris
*Attorney, Agent, or Firm*—Stevens, Davis, Miller & Mosher

[57] ABSTRACT

The magnetic core comprises a stack of plates which extend mainly along a single axial direction. The stack cross-section has as envelope a curve comprised of two half circles with a radius a/2 and of two straight lines with a length (b−a) which connect together the end points of the half circles. The ratio b/a lies between 1.05 and 2 and preferably between 1.3 and 1.7.

5 Claims, 4 Drawing Figures

ELLIPTICALLY SHAPED MAGNETIC CORE

BACKGROUND

This invention relates to a magnetic core comprised of a stack of plates which extend mainly along a single axial direction and which contact one another with the main surfaces thereof, and of which the stack cross-section has as envelope thereof a closed curve without discontinuities, which is of approximately ellipse shape, which has a first symmetry axis which lies in parallel relationship with the plates and a second symmetry axis at right angle thereto, whereby the spacing b between the intersection points of the curve with the second symmetry axis is markedly wider than the spacing a between the intersection points of the curve with the first symmetry axis.

A magnetic core is particularly used as part, for example as leg, of a transformer core, or as core of a choke coil.

Such a core is then surrounded by one or two windings. In that case where said magnetic core is one leg of a transformer core, it is generally surrounded by two windings, an innermost low-voltage winding and an outermost high-voltage winding.

Even if as already stated above, magnetic cores as a rule and the magnetic core according to the invention particularly may have various uses, for clearness' sake the use as leg of a transformer core will be mainly mentioned. This does not however exclude other uses according to the invention, and it will be clear for the man of the art that the principle defined in connection with the leg of a transformer core, is also valid for the other possible uses.

Various kinds of legs are known, notably legs which have at right angle to the axial direction, a cross-section with a circle as envelope and fill to the most said circle, and legs which have at right angle to the axial direction, a rectangular, possibly square cross-section.

For the sake of convenience said legs will be called hereinafter round and rectangular legs, respectively.

As well here as hereinafter, the wording "envelope" should be understood as the closed flowing curve, which has thus no discontinuities, which goes through all of the projecting angular points of that core cross-section which lies at right angle to the axial direction.

It is to be noted that it is generally conventional, as further explained hereinafter, to provide the required place for axially-located open feeders of low-voltage foil windings by means of a flattening of the leg cross-section, that is with a single-sided lowering of the stacking height of the stack. For the determination of the envelope, abstraction is made of said flattening, as this will be further explained hereinafter.

It is known to the man of the art how in the cases of round and rectangular legs, an economically optimum composition of the leg is to be reached and which particular specific advantages and disadvantages both said conventionally known embodiments may have.

There is known from FR-A-1,493,312, a transformer core of the above-defined kind wherein said envelope is ellipse-shaped or approximately of ellipse shape. The leg of such a transformer core, called hereinafter ellipse-shaped for convenience sake, offers relative to the round and rectangular legs, some advantages, allows particularly a more economic structure of the transformer for defined technical specifications, combines some advantages of the round and rectangular legs, and limits the disadvantages thereof.

Both the round and the known ellipse-shaped legs have however the disadvantage, that any change in the required cross-section of the magnetic core and consequently of the circle diameter or at least of one axis of the ellipse, causes a change in the required plate widths and mostly of the templates which are used during the manufacture and which have to relate with said envelopes.

THE INVENTION

The invention has particularly for object to obviate this disadvantage and to allow a large standardizing of the magnetic core manufacture, because with the same templates and with completely unchanged plate widths and mostly unchanged stacking heights, varying core cross-sections may be obtained.

For this purpose the curve is comprised of two halves from an ellipse, spaced along the short axis with dimension a, and of two straight lines which connect together the end points of the ellipse halves.

When the core cross-section is adapted by changing the length of the straight lines, the templates which relate to the half ellipses remain unchanged, and the step pattern, that is the width of the plates and the height of the stacks, may also remain unchanged within said half ellipses.

The curve is preferably comprised of two half circles with a radius a/2, and of two straight lines with a length (b−a) which connect together the end points of said half circles.

The ratio b:a preferably lies between 1.05 and 2, and particularly between 1.3 and 1.7.

It is to be noted that ratios b:a of 1.3 and 1.4 are known per se for an ellipse-shaped or approximately ellipse-shaped envelope, from FR-A-1,493,312, but then for an approximately ellipse-shaped envelope which is not composed according to this invention.

DESCRIPTION OF THE PREFERRED EMBODIMENT

Other features and advantages of the invention will stand out from the following description of a known leg of a transformer core, and of an embodiment of a magnetic core according to the invention for such a leg; the description of the embodiment according to the invention is only given by way of example and does not limit the invention; the reference numerals pertain to the accompanying drawings.

THE DRAWINGS

In the various figures, the same reference numerals pertain to similar elements or to elements which fulfil the same function.

THE DESCRIPTION

Figure 1:
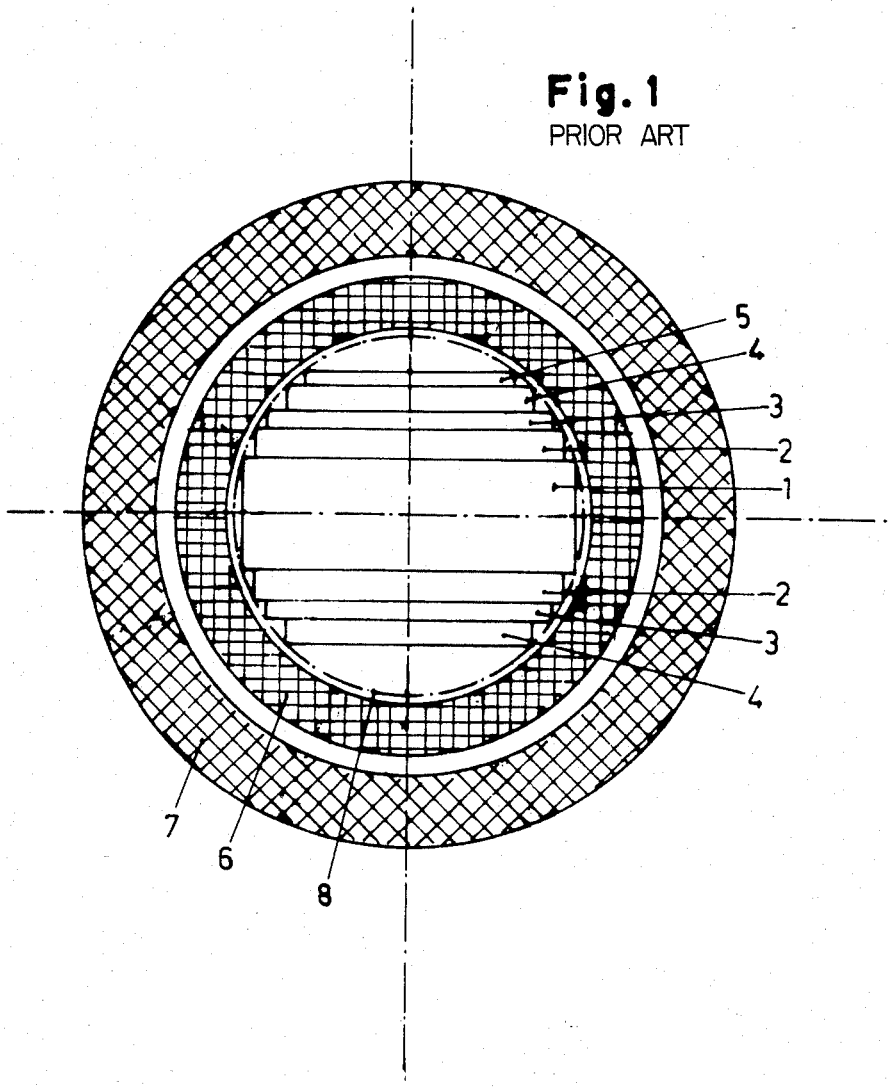
Fig. 1 PRIOR ART
FIG. 1 shows a cross-section at right angle to the axial direction, through a leg of a known transformer core, which is surrounded by a low-voltage and a high-voltage winding.

The leg of a known transformer core as shown in FIG. 1, is comprised of an array of plates stacked upon one another. The magnetic core of this leg is comprised of plates which are arranged according to packages 1 to 5.

The plates from one and the same package 1,2,3, 4 or 5 have the same width, but the plates from packages with a different number have a different width.

The plates engage one another with the main surfaces thereof. On each side of the center package 1, packages 2,3 and 4 are located, but with one of both packages 4 only is engaged by a package 5. Against the other package 4, the package 5 fails, because enough room should remain free there for the axially-located open feeders (not shown) from low-voltage foil windings. In the cross-section as shown in FIG. 1, which lies at right angle to the axial direction of the leg and thus of the magnetic core, the array has a circle 8 as envelope. As already stated above, said envelope is the curve which goes through all of the projecting angular points of the cross-section, whereby abstraction is made of the flattening of the stack or array for the axially-located open feeders from the low-voltage foil windings.

The stack of plates 1 to 5 is surrounded by an innermost low-voltage winding 6, which is surrounded in turn by an outermost high-voltage winding 7. Said windings 6 and 7 have the same axial direction which corresponds to the axial direction of the plate stack 1 to 5.

The required cross-section of stack 1–5 is dependent on the technical specifications for the transformer. For a given cross-section of the stack 1–5, the diameter and thus the circumference of the circumscribed circle decrease with the number of plate widths being used, as with more different widths, a larger portion of the circle surface area can be covered. The decrease in the circle circumference lowers the cost of the windings 6 and 7, which theoretically leads to the number of plate widths having to be as high as possible.

The rationalizing of the core structure limits the plate width number.

The choice of the plate width number is determined by the optimalizing of the total costs (materials and work costs) for the technical requirements stipulated for the transformer, and with said given plate width number the surface area of the circumscribed circle is filled to a maximum.

Figure 2:
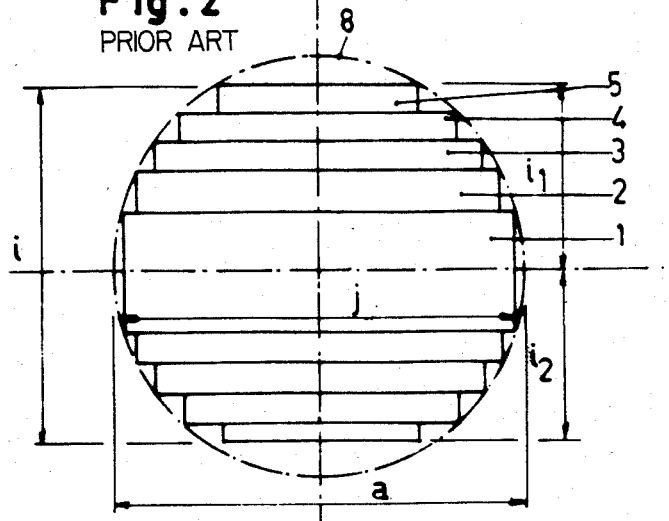
Fig. 2 PRIOR ART
FIGS. 2,3 and 4 show cross-sections at right angle to the axial directions, respectively through a known magnetic core, two halves from such a core, and a core derived therefrom according to the invention.
Figure 3:
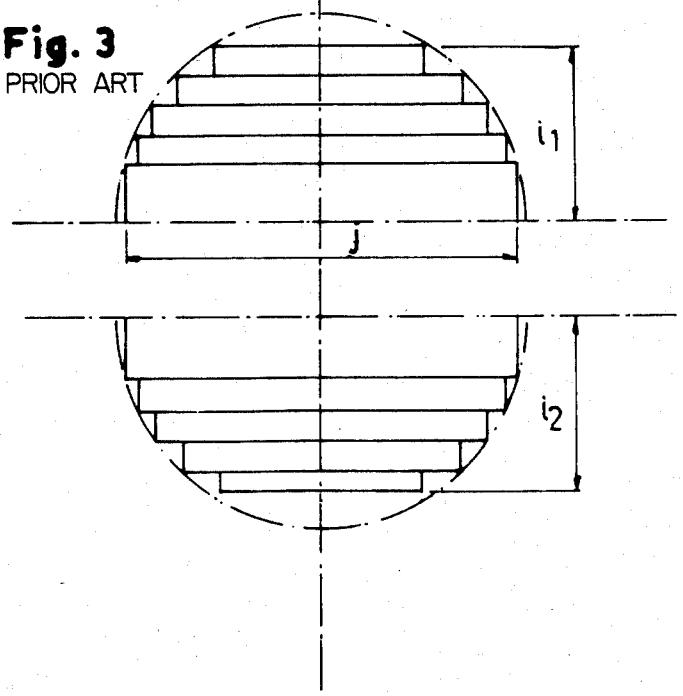
Fig. 3 PRIOR ART
Figure 4:
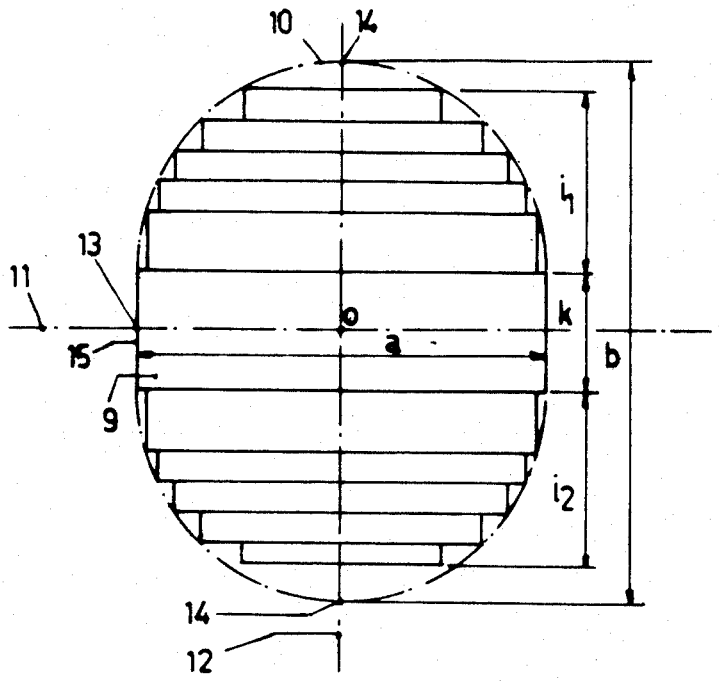

There will be shown with reference to FIGS. 2 to 4 how a leg according to the invention, as shown in FIG. 4, may be considered as being derived from a known leg as shown in FIG. 2, which known leg is of the round type according to FIG. 1.

The known core as shown in FIG. 2, comprised of stacks 1 to 5, is enveloped by the circle 8. The stacking height is i, the diameter of the circumscribed circle 8 is a, and the width of the widest plate is j. When said core is divided through the middle of stack 1, two half cores are obtained, respectively with a stacking height $i_1$ and $i_2$, $i_1+i_2=i$, but $i_1$ is not necessarily equal to $i_2$, because due to the above-mentioned flattening the stacking height $i_2$ of a flattened half core will be lower than the stacking height $i_1$ of the not-flattened half core. The widest plate from both half cores has a width j, that is the width of the widest plates in the original stack 1. As well $i_1$ as $i_2$ as j are smaller than a, the diameter of the directly circumscribed circle 8 in FIG. 2. Such division into two core halves is shown in FIG. 3.

When as shown in FIG. 4, between both said halve cores there is located a plate stack 9 with a plate width equal to a and a stacking height equal to k, there is then obtained a new magnetic core the widest plates of which, the plates from stack 9, have a width equal to the diameter a of the circumscribed circle 8 of the original magnetic core as shown in FIG. 2, and the total stacking height of which is equal to $i_1+i_2+k$, that is $i+k$.

The cross-section of this magnetic core is circumscribed by a curve 10 which is comprised of both original halves from the circle 8, and two straight line segments 15 which connect together the end points of the original half circles. Said curve 10 has two symmetry axes, namely a first symmetry axis 11 which lies in parallel relationship with the plates and divides the stack 9 into two equal parts, and a second symmetry axis 12 which lies at right angle thereto. Said symmetry axes 11 and 12 intersect one another in point 0. The spacing between the intersection points 13 of the enveloping curve 10 with the first symmetry axis 11 is equal to a, thus the diameter of the original circle 8; the spacing between the intersection points 14 of the second symmetry axis 12 with the enveloping curve 10, called b, is equal to $k+a$. The total stacking height is $k+i$, that is smaller than $k+a$.

Useful results with the magnetic core as shown in FIG. 4 are obtained when $1.05 \leqq b/a \leqq 2$, and preferably when $1.3 \leqq b/a \leqq 1.7$. The ratio b/a and consequently the value of k this ratio orginates from, are determined by optimalization computings of the total costs (materials+work costs) for the stipulated technical conditions (short-circuit losses, no-load losses, etc.).

When using magnetic cores of the type shown in FIG. 4, a strong standardizing of the measure a is possible, including the steps coupled therewith in the required plate widths and possibly the flattening to be provided for said open feeders from the low-voltage foil windings.

It is moreover possible to change the cross-section of the magnetic core by several percents, even up by more than 10%, without having to adapt the measure a, namely by adapting the measure k in the direct vicinity of the optimalized k value. It is thus possible to cover with a few fixed values for a, a wide series of transformers. By using a core as shown in FIG. 4, the total costs of the transformer will be lowered with a few percents relative to the costs of a transformer with legs of the type as shown in FIG. 1.

The embodiment as shown in FIG. 4 is preferably used for small powers, up to about 5000 kVA.

The invention is in no way limited to the above-described embodiment and within the scope of the patent application, many changes may be brought to the described embodiment, notably as regards the shape, the composition, the arrangement and the number of the components being used to embody the invention.

For instance, both half circles of the envlope may be replaced by two half ellipses.

I claim:

1. A magnetic core comprised of a stack of plates which extend mainly along a single axial direction and which contact one another with main surfaces, the cross-section having as envelope a closed curve without discontinuities comprised of two halves from an ellipse spaced along a short axis with dimension a and two straight lines which connect together end points of the half ellipses, said closed curve thus having a first symmetry axis which lies in parallel relationship with the plates and a second symmetry axis at right angle thereto, whereby the spacing b between intersection points of the curve with the second symmetry axis is markedly wider than the spacing a between intersection points of the curve with the first symmetry axis.

2. The magnetic core of claim 1, in which said two half ellipses are two half circles with a radius a/2 and said two straight lines thus have a length of (b−a).

3. The magnetic core of claim 2, in which the ratio b/a lies between 1.05 and 2.

4. The magnetic core of claim 2, in which the ratio b/a lies between 1.3 and 1.7.

5. The magnetic core of claim 1, having a flattening inside the envelope.

* * * * *